US007712481B1

(12) United States Patent
Mayer et al.

(10) Patent No.: US 7,712,481 B1
(45) Date of Patent: May 11, 2010

(54) SUCTION HOSE ARRANGEMENT FOR REFUSE TANK TRUCKS

(75) Inventors: Timothy G. Mayer, Metamora, IL (US); Joseph Schmidt, Tonica, IL (US); Eric Harcharik, Streator, IL (US)

(73) Assignee: Vactor/Guzzler Manufacturing, Inc., Streator, IL (US)

( * ) Notice: Subject to any disclaimer, the term of this patent is extended or adjusted under 35 U.S.C. 154(b) by 516 days.

(21) Appl. No.: 11/104,570

(22) Filed: Apr. 13, 2005

(51) Int. Cl.
*B65G 53/52* (2006.01)

(52) U.S. Cl. ..... 137/351; 137/355.24; 137/615

(58) Field of Classification Search ..... 137/615, 137/315, 351, 355.24; 15/340.1, 302, 304, 15/347
See application file for complete search history.

(56) References Cited

U.S. PATENT DOCUMENTS 2,990,785 A * 7/1961 Nielsen ..... 137/351
3,685,543 A * 8/1972 Schwing et al. ..... 137/615
3,789,869 A * 2/1974 Morris ..... 137/351
4,199,837 A * 4/1980 Fisco, Jr. ..... 15/302
4,659,262 A * 4/1987 van Aalst ..... 406/29
4,774,979 A * 10/1988 McKeon et al. ..... 137/351
5,062,868 A * 11/1991 Kennedy ..... 95/268
5,695,082 A * 12/1997 Rainwater ..... 212/177
5,913,323 A * 6/1999 Hudelmaier ..... 137/1
6,142,180 A * 11/2000 Woodling et al. ..... 137/615
6,220,292 B1 * 4/2001 Woodling et al. ..... 137/615
6,438,792 B1 * 8/2002 Cappellotto ..... 15/315
6,463,958 B1 * 10/2002 Schwing ..... 137/615
6,588,448 B1 * 7/2003 Raymond ..... 137/351
6,679,284 B1 * 1/2004 Raymond ..... 137/351
6,792,646 B1 * 9/2004 Greene et al. ..... 15/340.1
6,823,888 B1 * 11/2004 Raymond ..... 137/351

* cited by examiner

*Primary Examiner*—John Fox
(74) *Attorney, Agent, or Firm*—Finnegan, Henderson, Farabow, Garrett & Dunner, L.L.P.

(57) ABSTRACT

A tank truck is provided for collecting and transporting flowable material. The tank truck may include a tank configured to store flowable material, a retractable suction hose assembly connected to the tank and supported by a retractable boom, the suction hose assembly including an arrangement of telescoping tubes and a hose, and a drive assembly for selectively adjusting the horizontal and vertical position of the suction hose.

14 Claims, 15 Drawing Sheets

SUCTION HOSE ARRANGEMENT FOR REFUSE TANK TRUCKS

FIELD OF THE INVENTION

The present invention relates to tank trucks for collecting and transporting flowable refuse material, and, more particularly, to a suction hose handling and storage arrangement for such tank trucks.

DESCRIPTION OF THE RELATED ART

Tank trucks for collecting and transporting flowable refuse materials, such as storm drain sewage, septic tank sewage, certain chemical waste, leaves and the like, are typically equipped with a storage tank, a vacuum pump, and an at least partially flexible suction hose having one end connected to the tank and an opposite end (i.e., distal end) including a refuse pick-up nozzle. The suction hose may be supported by an adjustable boom on the truck so that at a site of refuse pick-up, the nozzle may be manipulated and positioned relative to the parked truck. Although the distance between the truck and the position of the nozzle is not large at most pick-up sites, some measure of suction hose length adjustability between the tank and the pick-up nozzle is sometimes desired.

In the past, various devices have been used to accommodate the limited variable length of the pick-up suction hose associated with tank trucks. For example, extensible suction hoses, a suction hose storage reel between the nozzle and the tank, or insertable suction hose sections have been employed. Because of the relatively large diameter of the suction hose, all of these devices present problems relating to efficient operation of the tank truck, use of the space available on the tank truck, and maintenance and/or replacement of the suction hose.

Accordingly, there is a need for improvement in refuse collecting and transporting tank trucks and, in particular, the provision of an improved arrangement for adjusting the length of the suction hose between the tank of such trucks and pick-up nozzle on the distal end of the suction hose.

SUMMARY OF THE INVENTION

In the following description, certain aspects and embodiments will become evident. Although the present invention may obviate one or more of the above-mentioned needs, it should be understood that some aspects and embodiments of the invention might not necessarily obviate at least some of those needs.

In one aspect, as embodied and broadly described herein, the invention is directed to a tank truck for collecting and transporting flowable material. The tank truck includes a tank configured to store flowable material, a retractable suction hose assembly connected to the tank, and a retractable boom supporting the hose assembly. A drive assembly engageable with the suction hose is provided for varying the vertical and horizontal length of the suction hose assembly, or a combination thereof.

In another aspect, as embodied and broadly described herein, the invention is directed to a tank truck for collecting and transporting flowable material. The tank truck includes a tank configured to store flowable material, a retractable suction hose assembly connected to the tank, and a retractable boom supporting the hose assembly. The retractable boom and suction hose assembly telescopes out so as to extend an overall horizontal displacement, variably, by a predetermined distance, and extends and retracts the suction hose such that the hose moves vertically with respect to the ground, variably, by a second predetermined distance. To further increase the overall functionality of the retractable hose and boom assembly, a telescoping catch basin nozzle is attached to the boom.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain some principles of the invention.

DESCRIPTION OF THE EMBODIMENTS

Figure 1:
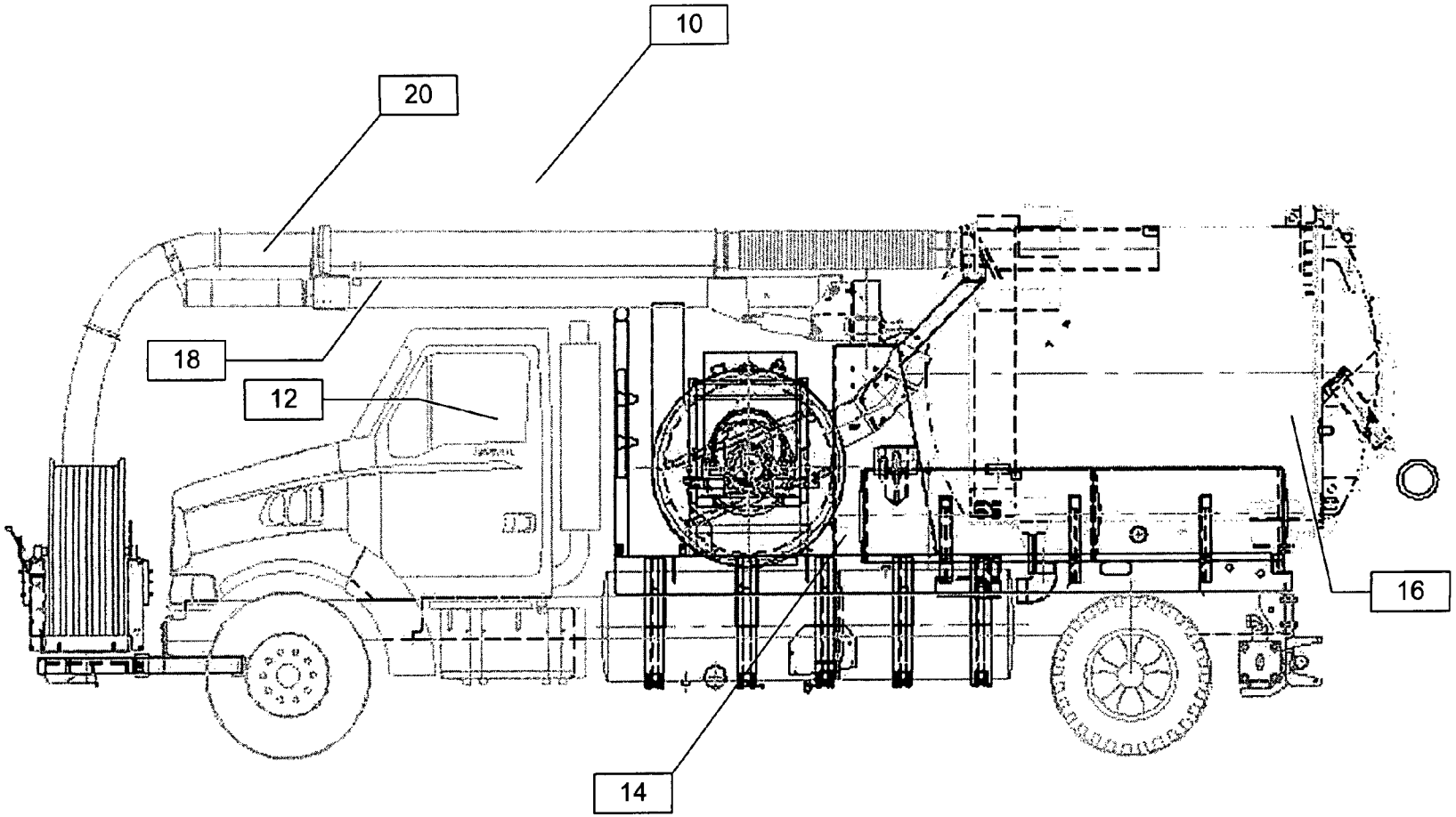
FIG. 1 is a schematic side elevation illustrating a tank truck in accordance with an embodiment of the present invention.

Reference will now be made in detail to the present exemplary embodiments of the invention, examples of which are illustrated in the accompanying drawings.

In accordance with the present invention, a tank truck for transporting flowable material is provided with a tank for storing the flowable material, a retractable boom and telescoping suction hose assembly connected at one end to the tank, and a drive assembly adapted to expand the boom and suction hose assemblies, thereby selectively adjusting the hose vertically and horizontally.

In the embodiments illustrated in FIGS. 1-22, a tank truck, generally designated by the reference number 10, includes a cab 12 and a truck body 14 supporting a refuse tank 16, a retractable boom assembly 18, a retractable suction hose assembly 20, and assorted equipment for operating the boom assembly 18, for subjecting the tank 16 to a negative pressure or vacuum, and in general, for complete operation of the tank truck 10 for sewer cleaning, storm drain cleaning, other types of catch basin cleaning, leaf collection, litter collection, hydroexcavation, industrial vacuum cleaning, and other pneumatic conveying applications. Since at least some of the assorted equipment may be conventional, the following description will be limited to components of equipment on the truck 10 that are relevant to the practice of the present invention.

Figure 4:
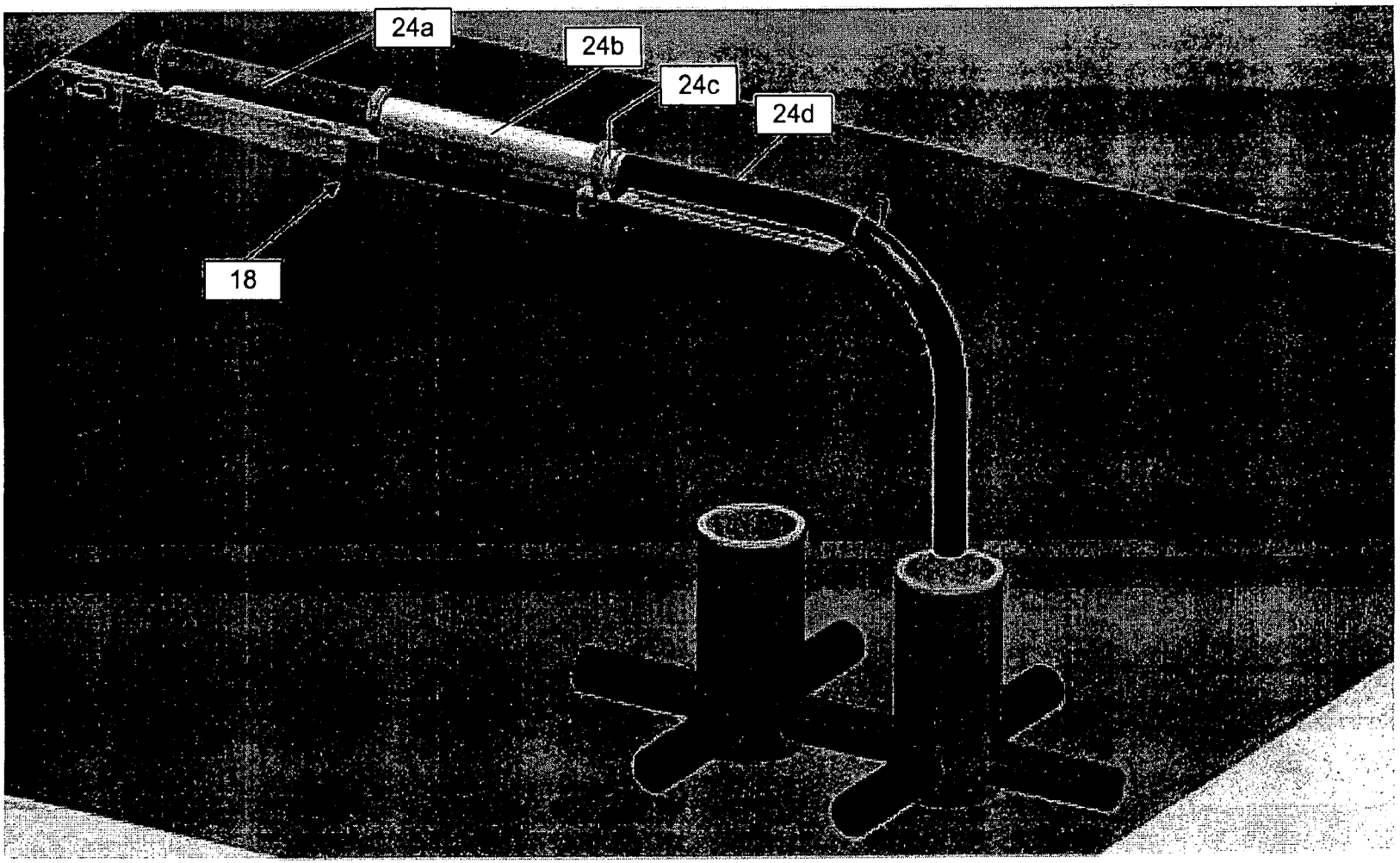
FIG. 4 is a perspective view of the boom assembly of FIG. 2 in a horizontally telescoped orientation.
Figure 5:
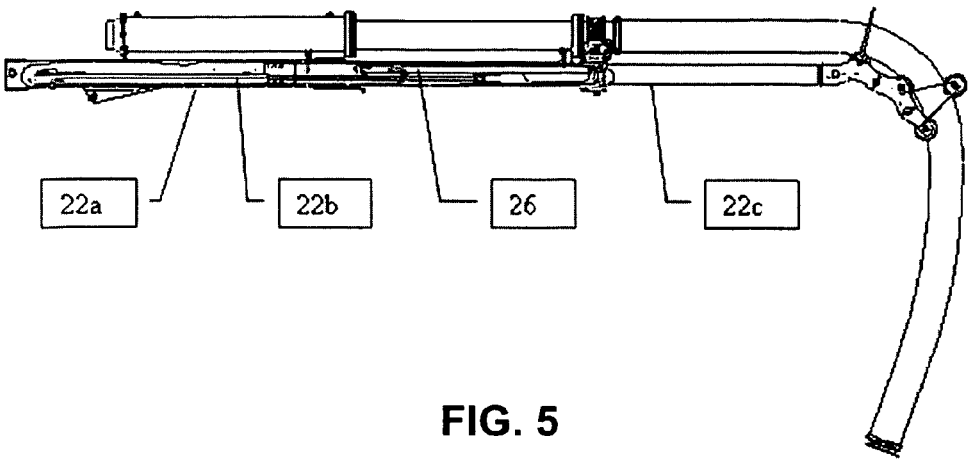
FIG. 5 is a side elevation illustrating the horizontally telescoped orientation of FIG. 4.
Figure 6:
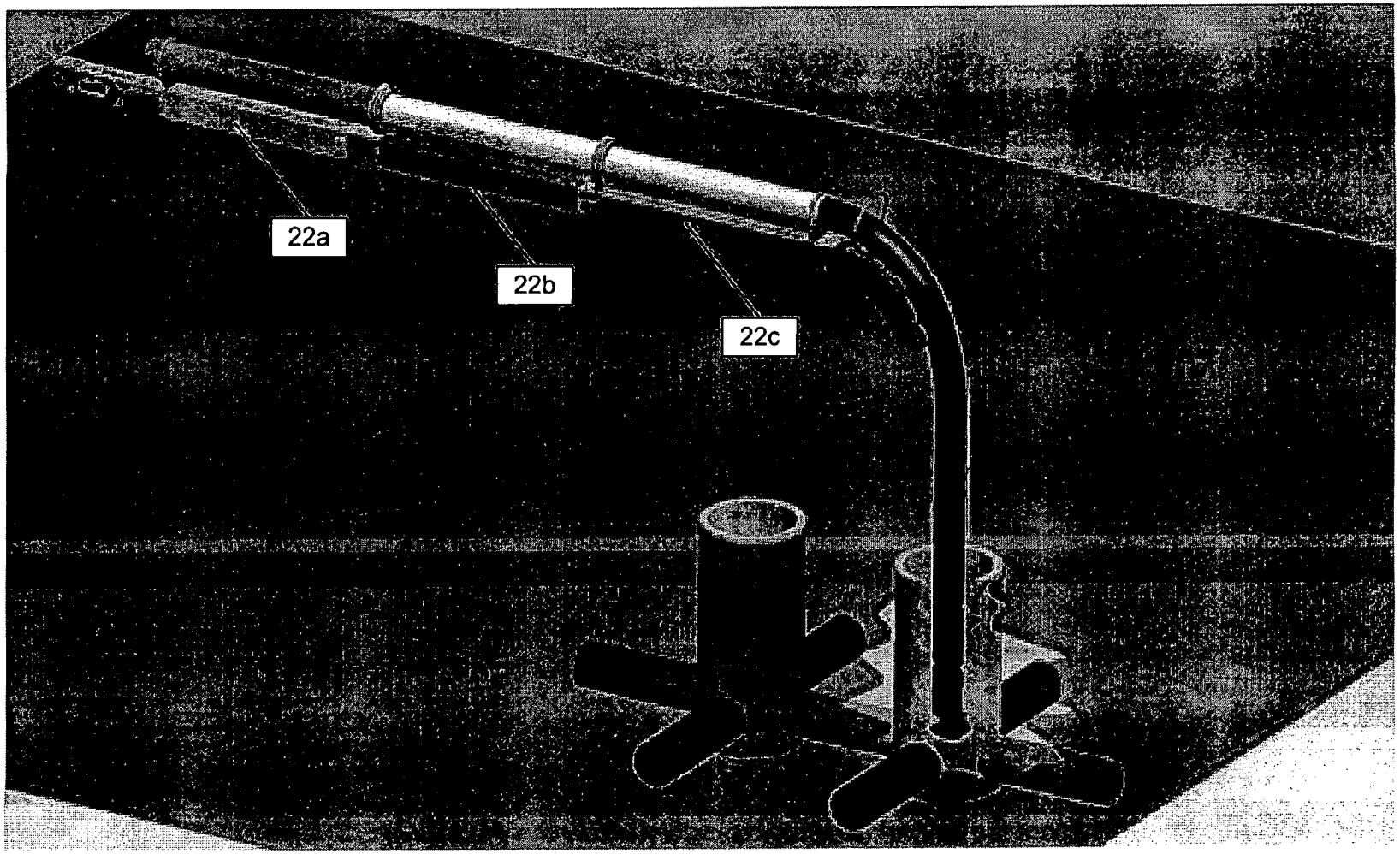
FIG. 6 is a perspective view of the boom assembly of FIG. 2 in a vertically telescoped orientation.

The retractable boom assembly 18 may be pivoted on top of the truck body 14 for horizontal swinging movement over the truck cab 12, and may include an arrangement of two or more telescoping boom sections 22*a*, 22*b*, 22*c*, as shown for example in FIGS. 5 and 6. In order to improve the overall functionality of the retractable boom assembly, the boom functions in various configurations. For example, in FIGS. 2 and 3, the boom is in a collapsed state. FIGS. 4 and 5 show the boom in a horizontally telescoped orientation. The boom is in the vertically telescoped orientation in FIGS. 6 and 7. In addition, the retractable boom assembly 18 may be mounted directly to the refuse tank 16 and function as described above. Optionally, the retractable boom assembly 18 may be mounted to the side of the refuse tank 16, configured in a side-by-side telescoping boom fashion as opposed to the current over-under boom arrangement. This design can also function as described above.

Figure 2:
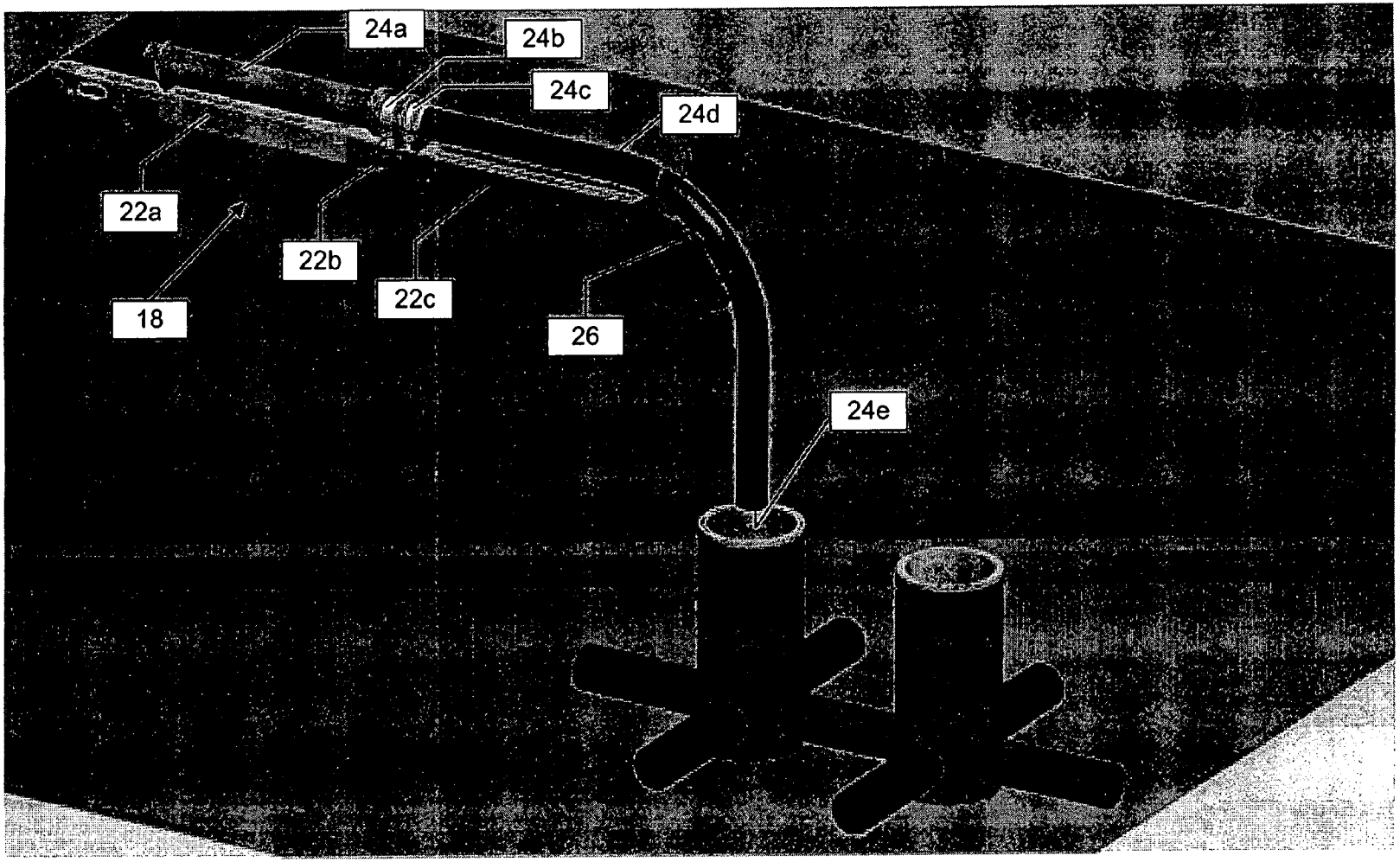
FIG. 2 is a perspective view illustrating an exemplary boom assembly for the truck of FIG. 1, wherein the boom assembly is in a collapsed orientation.
Figure 3:
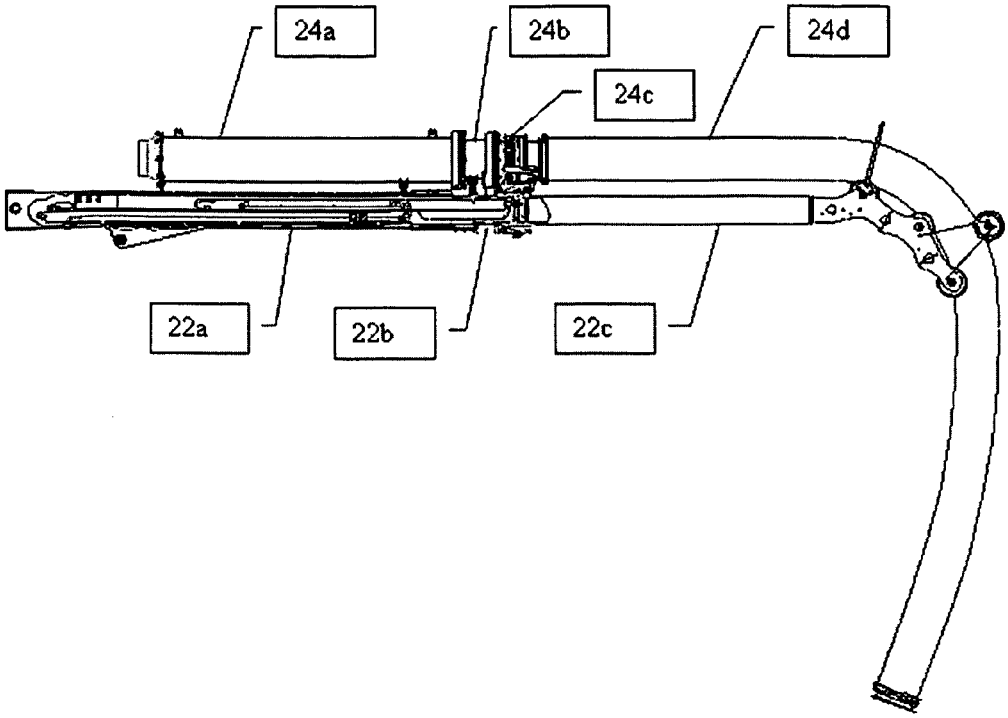
FIG. 3 is a side elevation illustrating the collapsed orientation of the boom assembly of FIG. 2.
Figure 8:
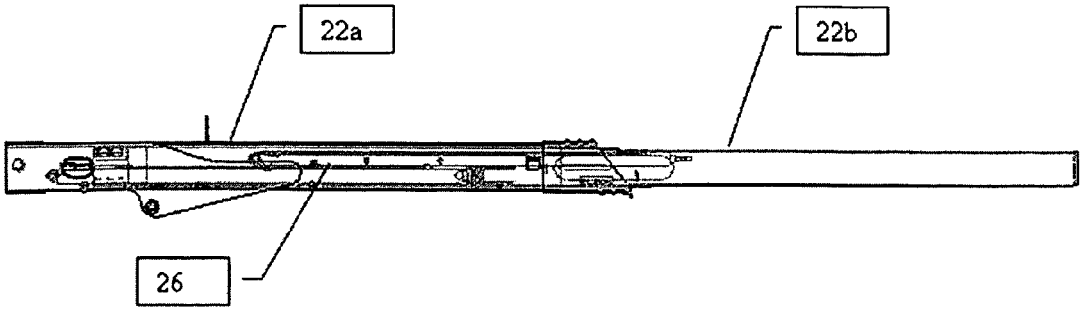
FIG. 8 is a side elevation illustrating the boom assembly of FIG. 3 in more detail.
Figure 7:
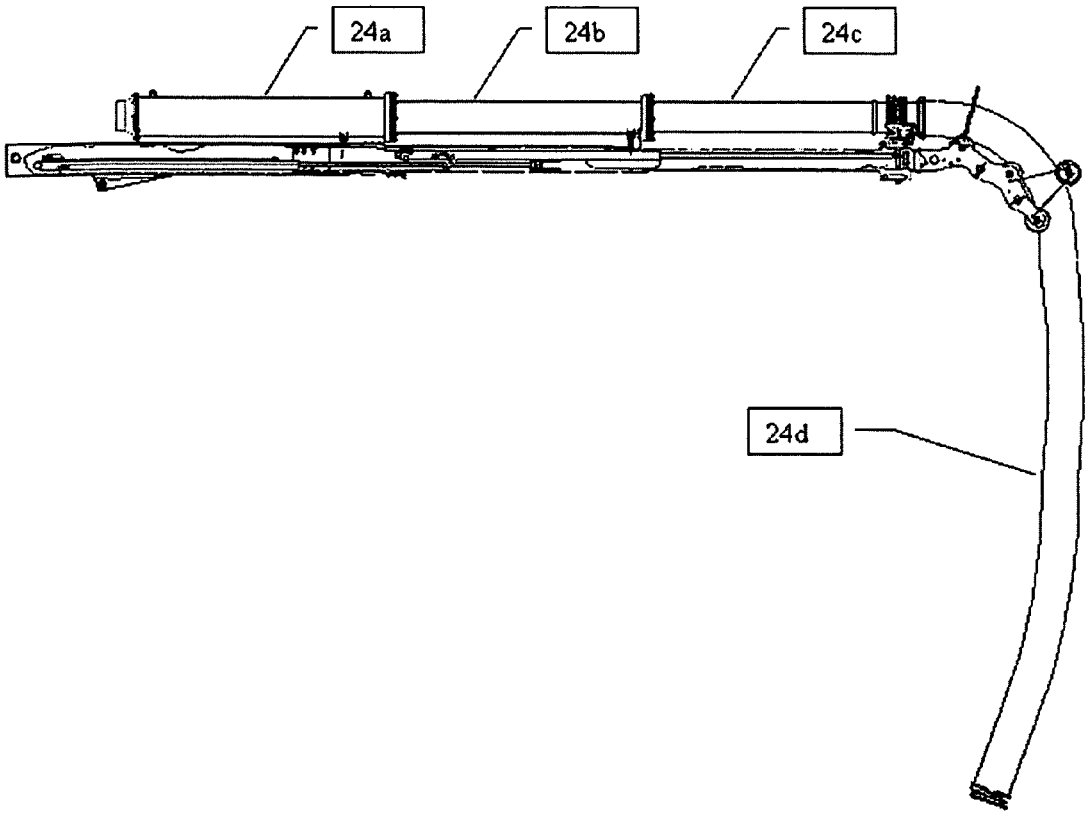
FIG. 7 is a side elevation illustrating the vertically telescoped orientation of FIG. 6.

In accordance with the present invention, the suction hose assembly 20 is connected to the front end of the refuse tank 16 and comprises an arrangement of at least two telescoping tubes. As shown in FIGS. 4 and 7, the suction hose assembly 20 preferably includes an outer tube 24*a*, a middle tube 24*b*, an inner tube 24*c*, and a flexible hose 24*d* having a distal end 24*e*. In some examples, the inner tube 24*c* is configured to have an outer diameter less than the outer diameter of the middle tube 24*b*, which is less than the outer diameter of the outer tube 24*a*. Therefore, the hose may be collapsed with the inner tube 24*c* and the middle tube 24*b* positioned substantially entirely within the outer tube 24*a*, as shown in FIG. 2.

In accordance with the present invention, the retractable suction hose assembly 20 is connected to the retractable boom assembly 18. As embodied herein and shown principally in FIG. 9, the inner tube 24*c* is slidably connected to the boom assembly 18 along boom section 22*c*, the middle tube 24*b* is secured to boom section 22*b*, while the outer tube 24*a* is affixed to boom section 22*a*. To facilitate motion, at least two rollers 26 are mounted along a distal end of the boom and are engageable with the sides of the suction hose assembly 20.

In accordance with the present invention, the truck includes a drive assembly for controlling the horizontal and vertical position of the distal end 24*e* of the hose 24*d* relative to the truck. As embodied herein and shown principally in FIG. 10, the drive assembly may include lower and upper hydraulic cylinders 28, 30 mounted substantially within boom portions 22*a*, 22*b*. Upper hydraulic cylinder 30 is also fixed at one end to a slide bearing 32, which is secured to inner tube 24*c* and adapted to move along boom portion 22*c* when actuated by upper cylinder 30. In an extended state, the upper cylinder 30 is actuated to move the slide bearing along boom section 22*c*; whereas in the telescoped state the lower cylinder extends boom section 22*b* which is telescopically mounted within boom section 22*a*.

Figure 9:
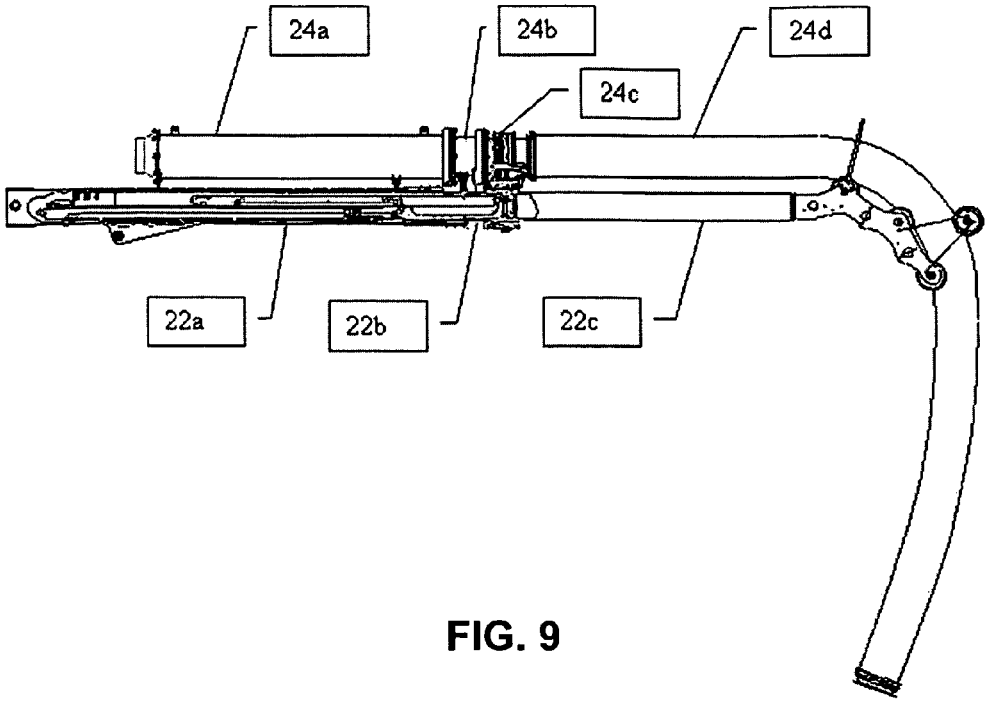
FIG. 9 is a side view of the boom in its stored, non-actuated state.
Figure 10:
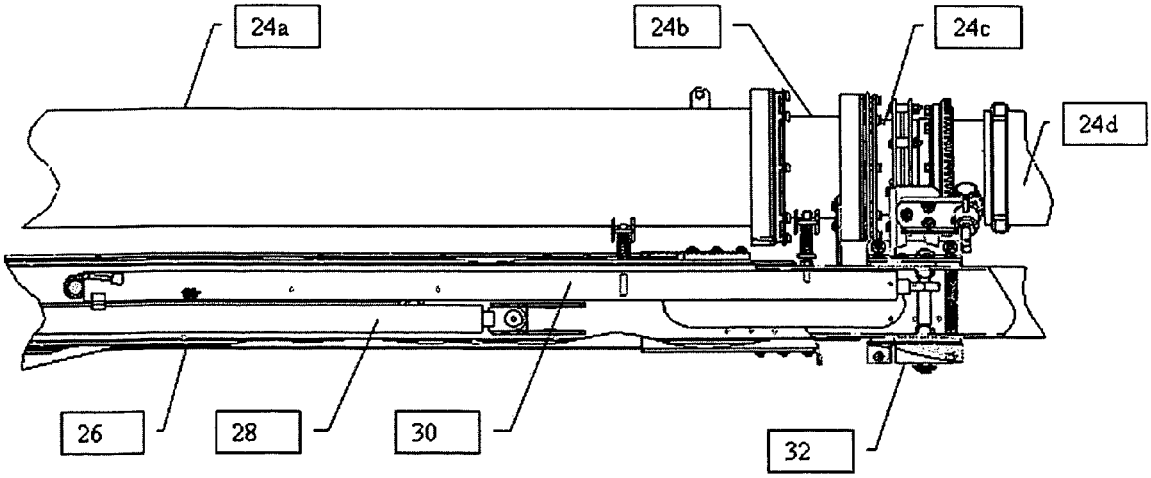
FIG. 10 is a side view featuring the drive assembly for the boom and the hose.

The boom and hose assemblies 18, 20 are normally stored in a non-actuated state, as shown in FIG. 9, in which the inner tube 24*c* is positioned within the middle tube 24*b* which is positioned within the outer tube 24*a*.

Figure 11:
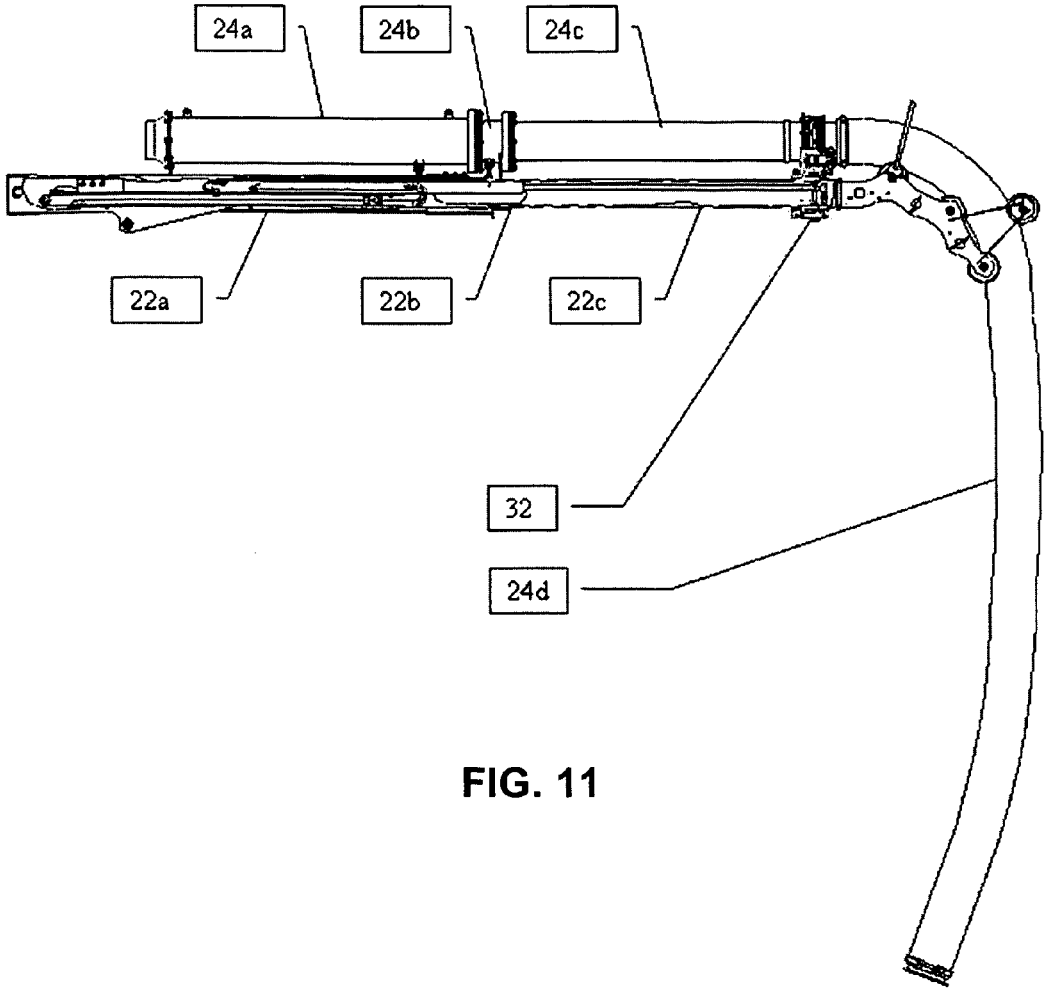
FIG. 11 is a side view of the boom in the extended but not telescoped state.

As shown in FIG. 11, the boom and hose assemblies 18, 20 may be configured in an extended but not telescoped state. In this configuration, the upper cylinder 30 moves the slide bearing 32 along the boom section 22*c*, so that the slide bearing 32 substantially abuts rollers 26. In doing so, the slide bearing 32 draws the inner tube 24*c* out of the middle tube 24*b*, which does not move relative to the outer tube 24*a*. Thus, the hose 24*d* moves vertically only, as shown in FIG. 11, because horizontal length of the boom assembly 18 has not been adjusted, while the hose assembly has been extended.

Figure 12:
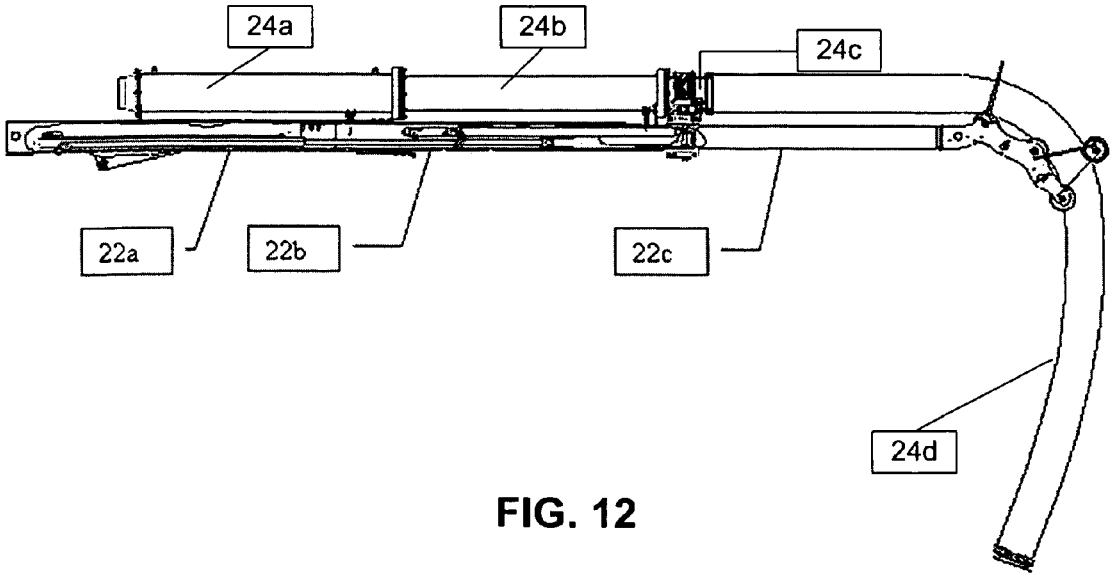
FIG. 12 is a side view of the boom in the telescoped but not extended state.

As shown in FIG. 12, the boom and hose assemblies 18, 20 may be configured in a telescoped but not extended state. In this configuration, only the lower cylinder 28 is actuated. Once actuated, the lower cylinder 28 urges boom section 22*b* out of boom section 22*a*. This, in turn, draws the middle tube 24*b* out of the outer tube 24*a*. The middle tube 24*b* and the inner tube 24*c* do not move relative to one another. Thus, the hose 24*d* will be adjusted horizontally only.

Figure 13:
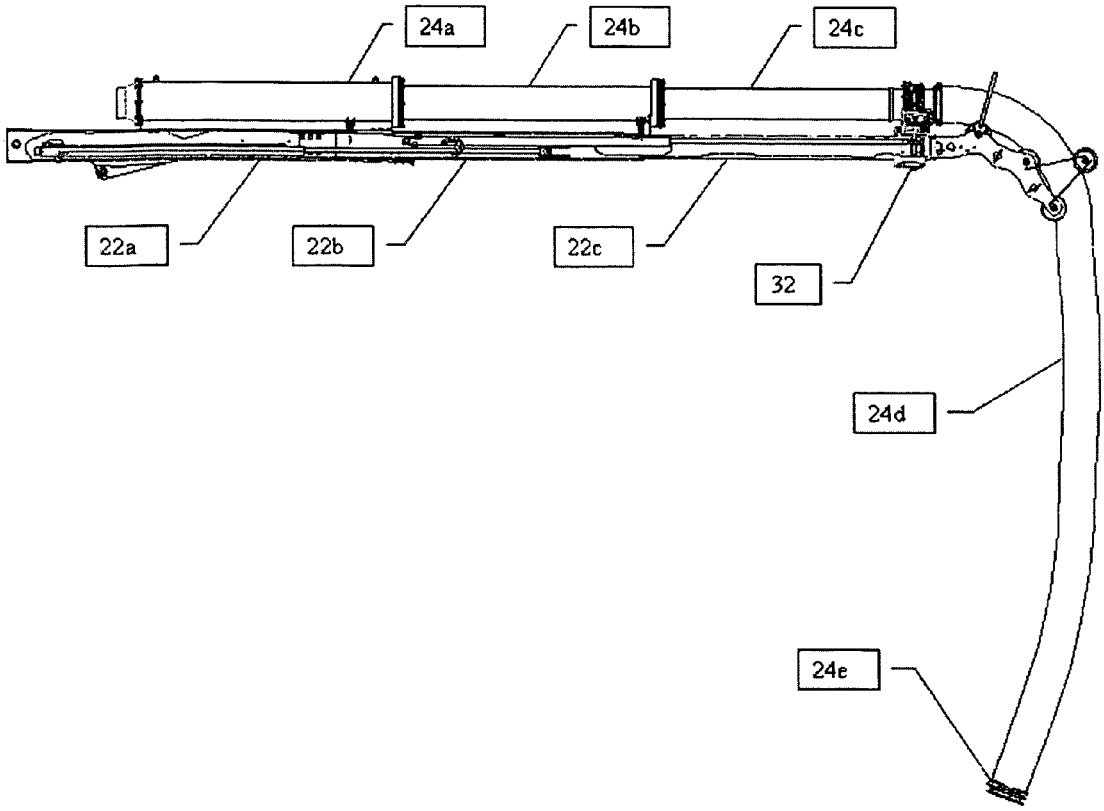
FIG. 13 is a side view of the boom in the telescoped and extended state.

As shown in FIG. 13, the boom assembly 18 may be configured in a telescoped and extended state. In this configuration, lower and upper cylinders 28, 30 are actuated sequentially or in unison. In the process, the inner tube 24*c* is drawn out of the middle tube 24*b*, which is drawn out of the outer tube 24*a*. Thus, the hose 24*d* will move both horizontally and vertically.

Figure 14:
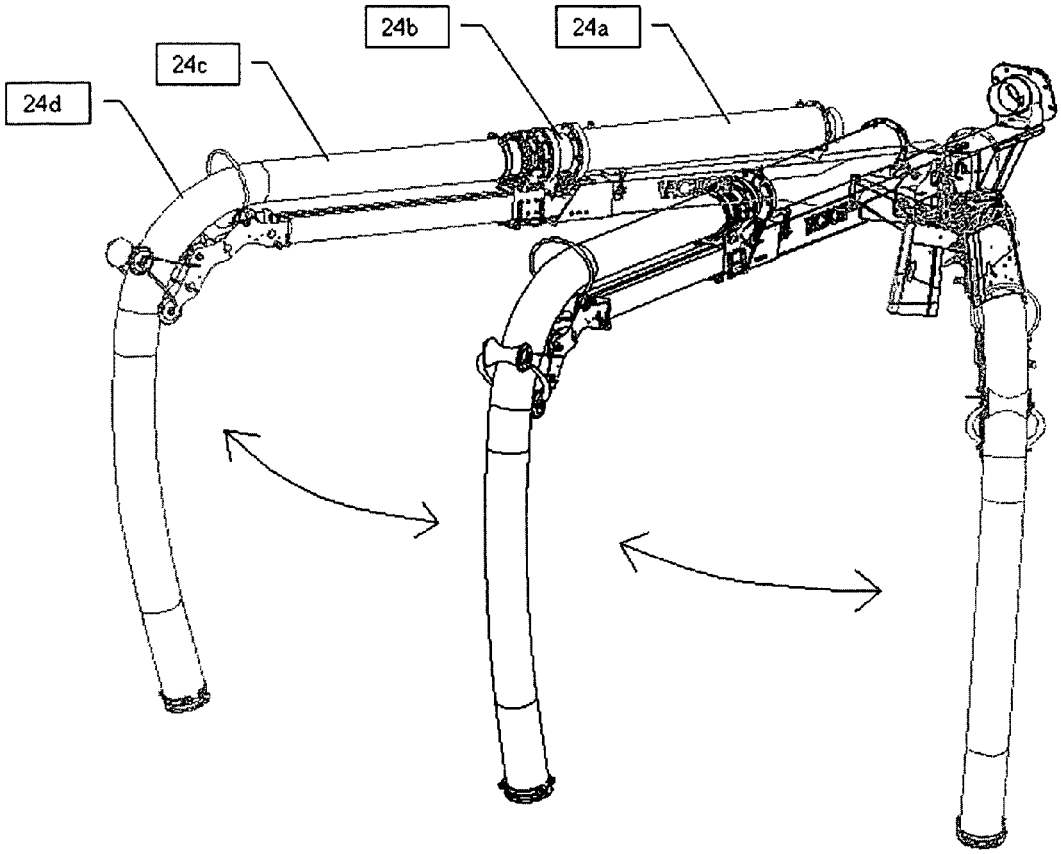
FIG. 14 is a side view of the boom in the side to side rotated state.
Figure 15:
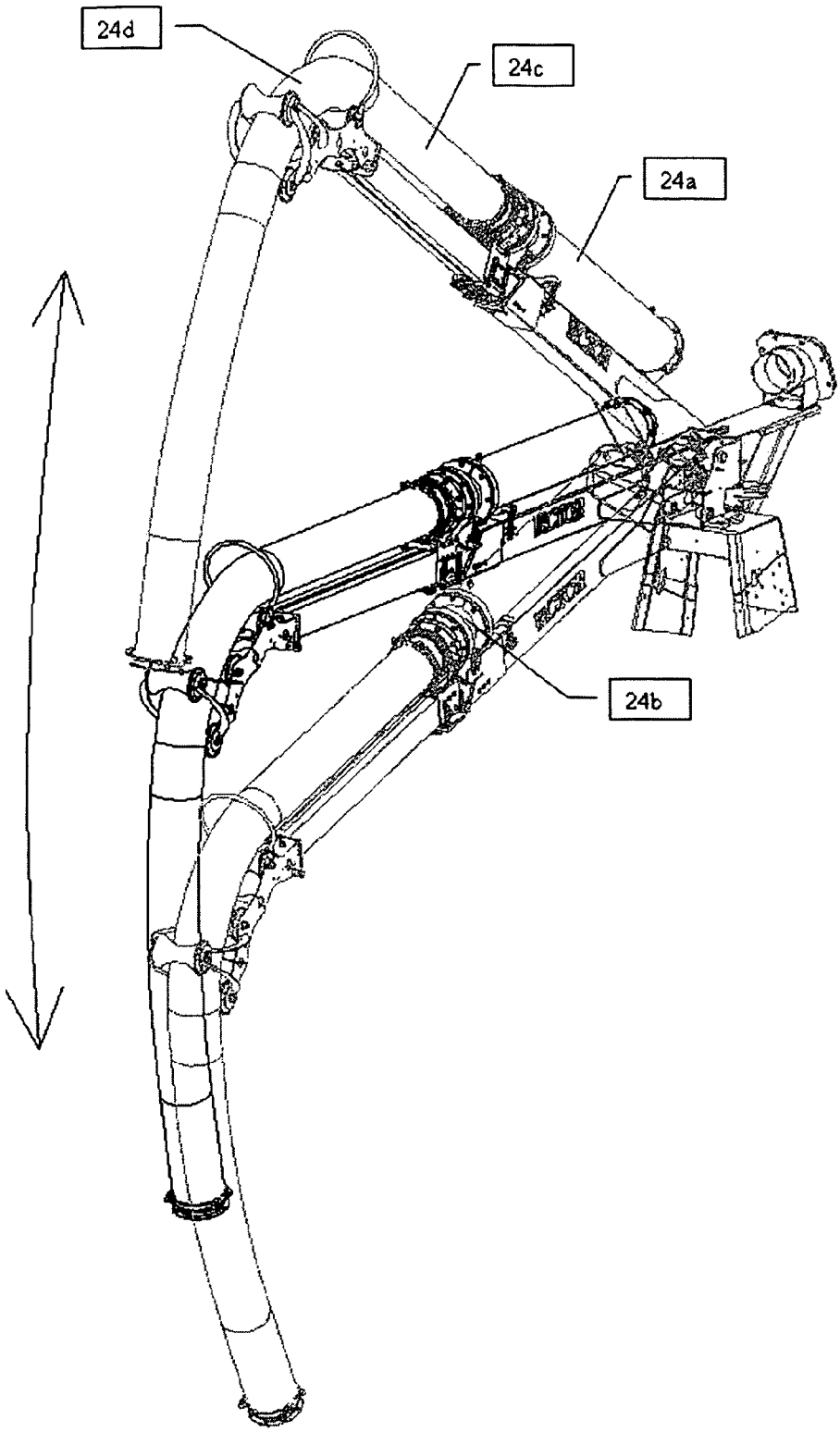
FIG. 15 is a side view of the boom in up and down pivoted state.

Hydraulic actuated cylinders also may be used to facilitate side-to-side rotating motion shown in FIG. 14 (i.e., pivotal movement about a vertical axis), as well as up and down pivoting as shown in FIG. 15 (i.e., pivotal movement about a horizontal axis). All cylinders are controlled by valves and levers enabling individualized user control.

Figure 21:
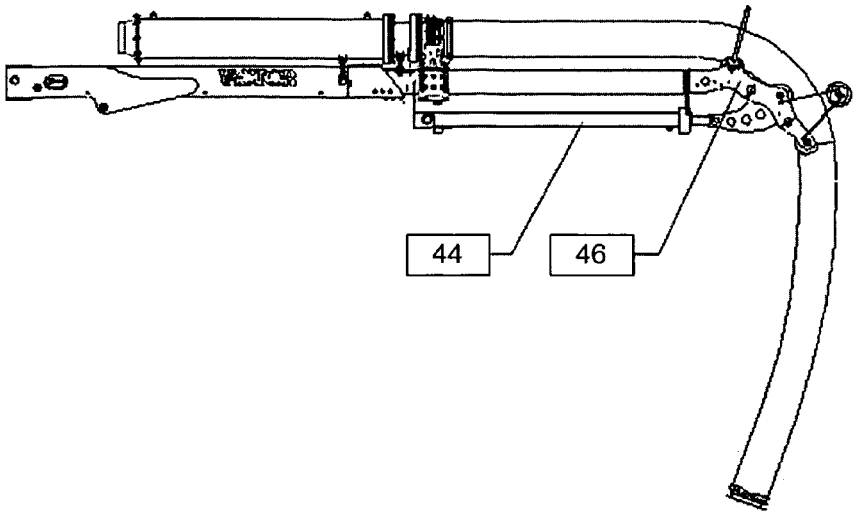
FIG. 21 is a side view of the boom with a third cylinder in its stored, non-actuated state.
Figure 22:
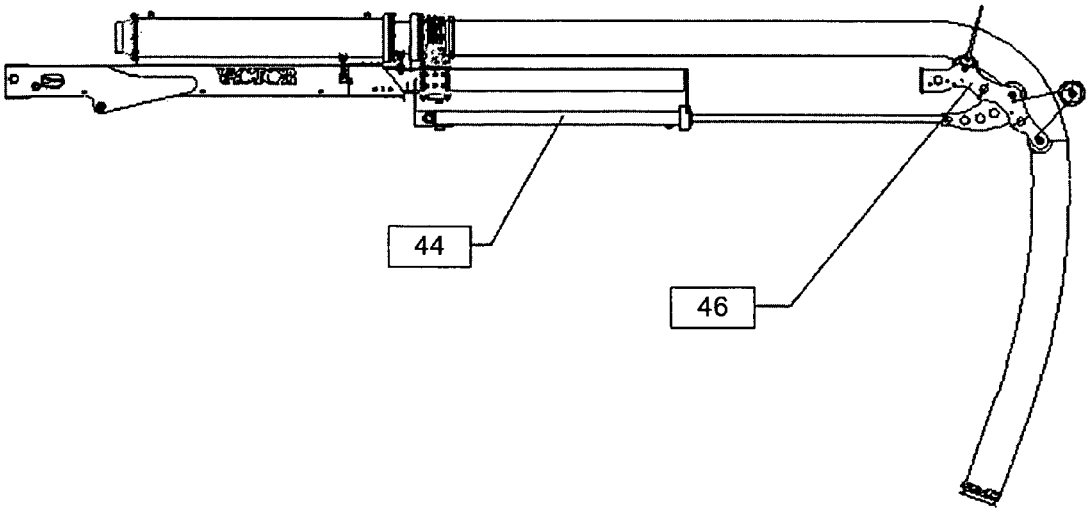
FIG. 22 is a side view of the boom with a third cylinder in the telescoped state.

As shown in FIGS. 21 and 22, the boom assembly 18 may include a third cylinder 44 to provide an additional amount of overall horizontal telescoping boom length. The third cylinder 44 is extended by a predetermined distance, which extends the front roller end 46 and thus the overall total extension of the boom by the predetermined distance. In addition to hydraulics, the present invention may be actuated by other drive mechanisms, including, but not limited to, ball-screws powered by a motor, air cylinders, cables, etc. In addition, the drive mechanism 26 may be positioned outside the boom, such as on the truck body 14.

In operation, the hose and boom arrangement not only telescopes out in such a way as to extend its overall length by a predetermined distance, but also can extend and retract the hose such that the distal-end 24*e* moves vertically with respect to the ground by a second predetermined distance. Additionally, the boom may be inclined up or down so that the hose is extended at an angle greater than or less than 90° relative to the boom.

Figure 19:
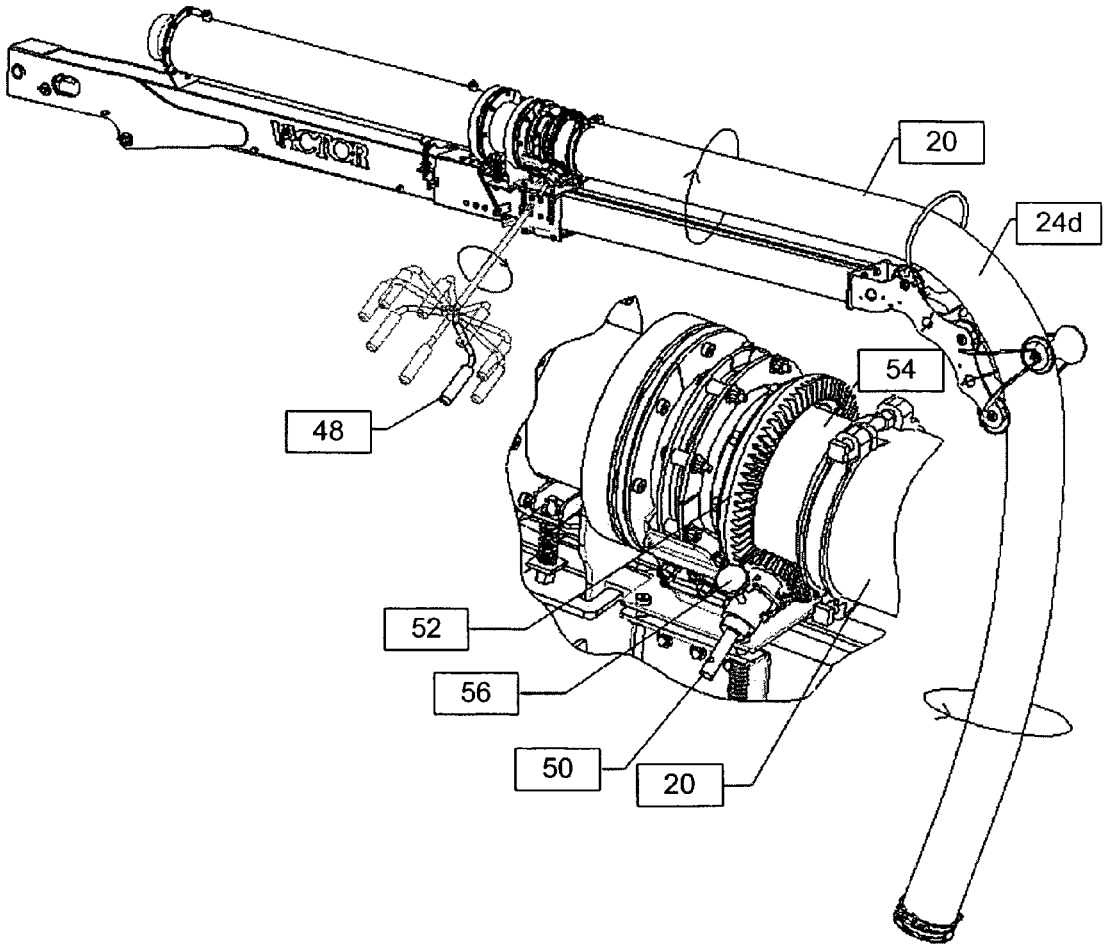
FIG. 19 is a side view of the boom with a gear mechanism.

As shown in FIG. 19, the boom assembly 18 may include a gear mechanism designed to increase the life span of the retractable hose assembly 20, including inner tube 24*c*. The retractable hose 20 wears from use most heavily in area 24*d* inside the hose and opposite the rollers 26. When crank 48 is rotated in a clockwise or counter-clockwise motion, hose 20 and correspondingly, parts and sections 50, 52, and 54 will also rotate. Section 54 is connected directly to inner tube 24*c*, causing inner tube 24*c* to rotate as well. The end goal is to rotate sequentially 90° at a specified interval to evenly distribute the wear, thus maximizing hose life. In this new position, area 24*d* is no longer worn out and is ready for continued use. The rotation motion can also be locked and unlocked via a locking mechanism 56.

Figure 20:
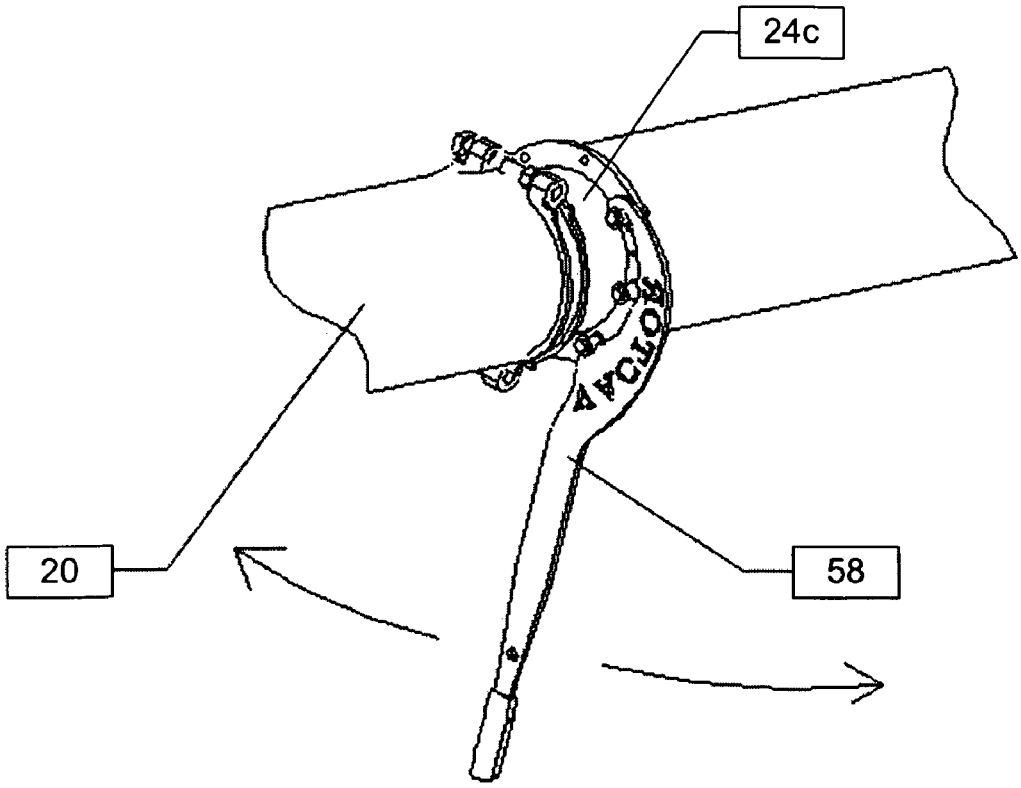
FIG. 20 is a side view of the boom with a wrench mechanism.

In the alternative, FIG. 20 illustrates a wrench mechanism designed to increase the life span of the retractable hose assembly 20, including inner tube 24*c*, as described above in FIG. 19. As opposed to the crank 48 and gear mechanism, a wrench 58 may attach to the hose end of inner tube 24*c*. As the wrench 58 is turned sequentially 90° clockwise or counterclockwise, at a specified interval to evenly distribute the wear, all of the corresponding parts and sections 50, 52, and 54 will rotate in the same manner as in the gear mechanism of FIG. 19.

Figure 16:
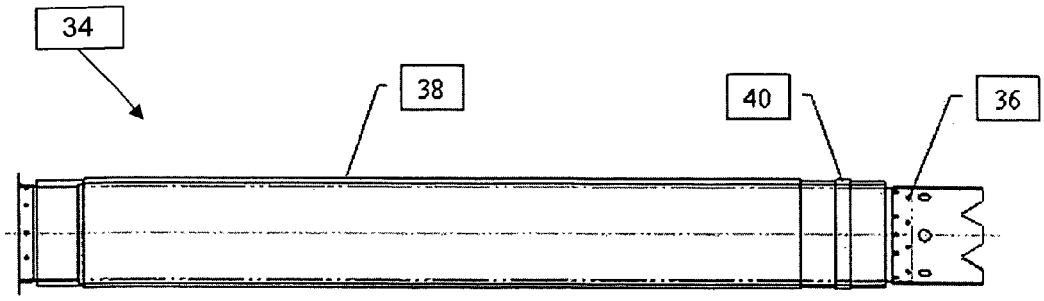
FIG. 16 is a perspective view of the boom with catch basin nozzle in its stored, non-actuated state.
Figure 17:
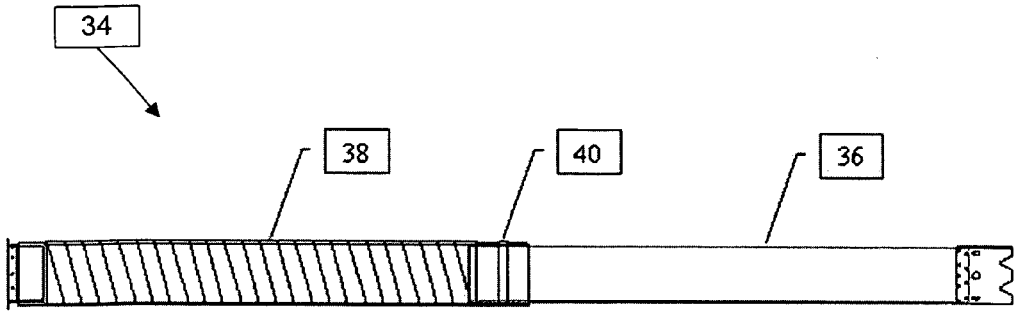
FIG. 17 is a perspective view of the boom with catch basin nozzle in the telescoped state.
Figure 18:
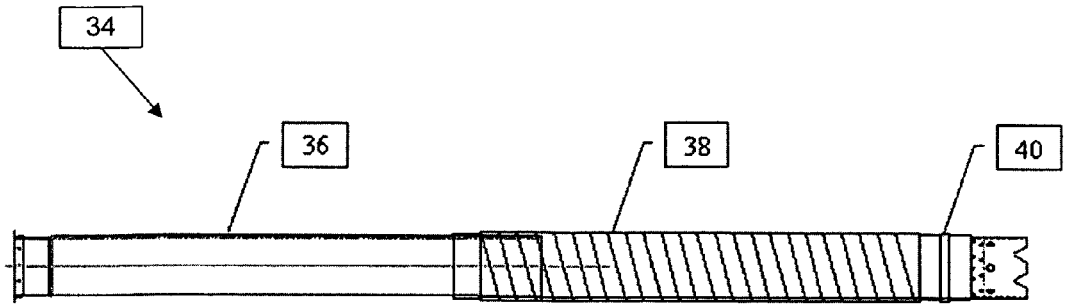
FIG. 18 is an additional perspective view of the boom with catch basin nozzle in the telescoped state.

Further, in accordance with the present invention and as shown in FIGS. 16-18, a telescoping catch basin nozzle 34 may be attached to the hose 24*d* to increase the overall operation of the tank truck. The nozzle 34, which is manually operated, comprises two tubes, an inner tube 36 and an outer tube 38. The inner tube 36 preferably is constructed from aluminum, while the outer tube 38 preferably is made of rubber or similarly resilient polymeric material. The inner tube 36 is configured to have an outer diameter less than an inner diameter of the outer tube 38. The outer tube 38 further comprises a clamping or sealing system 40 to allow the inner tube 36 to adjust in and out. The other end of the outer tube 38 has a rolled angle flange connection 42. In FIG. 16, the telescoping catch basin nozzle 34 is in its stored, non-actuated state. As the clamping or sealing system 40 is manually adjusted, the inner tube 36 extends with the aid of gravity to a telescoped state, as shown in FIGS. 17 and 18.

Other embodiments of the invention will be apparent to those skilled in the art from consideration of the specification and practice of the invention disclosed herein. For example, the boom can move the distal-end 24*e* vertically and horizontally, vertically but not horizontally, and horizontally but not vertically with respect to the ground by performing different combinations of telescoping and extending.

What is claimed is:

1. A tank truck for collecting and transporting flowable material comprising:

a tank configured to receive and store the flowable material;

a retractable boom assembly mounted on the truck including an arrangement of telescoping sections;

a retractable suction hose assembly connected to the tank and mounted on top of the retractable boom assembly, including an arrangement of telescoping tubes and a flexible hose, the hose having a first end connected to the last one of the tubes and a distal end opposite the first end;

a drive assembly mounted within the retractable boom assembly and connected to the retractable hose assembly for extending and retracting the retractable boom and the hose assemblies; and a moveable support guide connected to one of the telescoping tubes and adapted to slide along at least one of the telescoping sections, wherein a length of the telescoping tubes expands as the moveable support guide moves along at least one of the telescoping sections.

2. The tank truck as defined in claim 1, wherein the drive assembly includes a horizontal adjustment control system and a vertical adjustment control system.

3. The tank truck as defined in claim 2, wherein the horizontal and vertical control systems operate in sequence.

4. The tank truck as defined in claim 1, wherein the horizontal and vertical control systems operate simultaneously.

5. The tank truck as defined in claim 1, wherein the boom assembly is configured to pivot together about a vertical axis.

6. The tank truck as defined in claim 1, wherein the boom is configured to pivot about a horizontal axis.

7. The tank truck as defined in claim 1, wherein the moveable guide support is connected to the vertical control system, such that actuation of the vertical control system expands the length of the telescoping tubes as the moveable guide support moves along at least one of the telescoping sections, thereby adjusting the vertical position of the distal end of the hose.

8. The tank truck as defined in claim 1, wherein the telescoping sections are connected to the telescoping tubes, and wherein the horizontal control system is operatively connected to the telescoping sections, such that actuation of the horizontal control system expands the length of the telescoping tubes and the telescoping sections, thereby adjusting the horizontal position of the distal end of the hose.

9. The tank truck as defined in claim 8, wherein the boom assembly includes an additional horizontal control system, such that actuation of the additional horizontal control system expands the length of the telescoping tubes and the telescoping sections by an additional length.

10. The tank truck as defined in claim 1, wherein the hose assembly includes a telescoping nozzle assembly mounted on the distal end of the hose.

11. The tank truck as defined in claim 1, wherein the boom assembly includes rollers extending from the arrangement of telescoping sections for supporting the hose.

12. The tank truck as defined in claim 1, wherein the hose assembly includes a gear mechanism mounted within the arrangement of telescoping tubes.

13. The tank truck as defined in claim 1, wherein the hose assembly includes a wrench mechanism mounted within the arrangement of telescoping tubes.

14. The tank truck as defined in claim 1, wherein the drive assembly selectively adjusts the vertical and horizontal positions of the distal end of the hose.

* * * * *